US006302002B1

(12) United States Patent
Defer

(10) Patent No.: US 6,302,002 B1
(45) Date of Patent: Oct. 16, 2001

(54) METHOD AND APPARATUS FOR SERVICING AN INTERNAL COMBUSTION ENGINE

(75) Inventor: Michael Defer, St. Clair Shores, MI (US)

(73) Assignee: Chrysler Corporation, Auburns Hills, MI (US)

( * ) Notice: Subject to any disclaimer, the term of this patent is extended or adjusted under 35 U.S.C. 154(b) by 0 days.

(21) Appl. No.: 09/528,763

(22) Filed: Mar. 17, 2000

Related U.S. Application Data

(62) Division of application No. 09/158,702, filed on Sep. 22, 1998.

(51) Int. Cl.[7] ..... B25B 11/00
(52) U.S. Cl. ..... 81/488; 81/484
(58) Field of Search ..... 81/484, 488; 29/402.08, 29/888.11

(56) References Cited

U.S. PATENT DOCUMENTS 1,466,196 * 8/1923 Seiders ..... 81/488
2,666,945 * 1/1954 Kelly .
4,027,365 6/1977 Froeliger ..... 29/888.011
4,373,240 2/1983 Castoe ..... 29/888.011
4,726,263 * 2/1988 Lake ..... 81/484
5,323,889 * 6/1994 Bednarek ..... 81/488

* cited by examiner

*Primary Examiner*—D. S. Meislin
(74) *Attorney, Agent, or Firm*—Mark P. Calcaterra

(57) ABSTRACT

An apparatus for servicing an engine cylinder head of an internal combustion engine includes a mounting portion adapted to be removably attached to the engine cylinder head. The apparatus additionally includes a support portion for radially supporting the cam sprocket. The support portion is generally cylindrical in shape and adapted to align with the cam shaft. The apparatus is intended to maintain the radial position of a cam sprocket during removal of the cam shaft. The mounting portion preferably includes a pair of apertures adapted to align with a pair of apertures in the cylinder head. Further, the mounting portion is generally planar and the support portion extends substantially parallel to a plane defined by the mounting portion. A method of servicing an engine cylinder head having a cam sprocket mounted for rotation on a cam shaft includes the general steps of providing a sprocket mounting member, removably attaching the sprocket mounting member to the engine cylinder head, radially supporting the cam sprocket on the sprocket mounting member, removing the cam shaft from the engine cylinder head and maintaining a radial position of the cam sprocket.

4 Claims, 3 Drawing Sheets

METHOD AND APPARATUS FOR SERVICING AN INTERNAL COMBUSTION ENGINE

This is a division of U.S. patent application Ser. No. 09/158,702, filed Sep. 22, 1998.

BACKGROUND OF THE INVENTION

1. Technical Field

The present invention generally pertains to motor vehicles. More particular, the present invention pertains to a method and apparatus for servicing an internal combustion engine. More specifically, but without restriction to the particular embodiment and/or use which is shown and described for purposes of illustration, the present invention relates to a method and apparatus for maintaining cam sprocket alignment while the cam shaft of an engine is removed for servicing the engine.

2. Discussion

In a conventional motor vehicle having an internal combustion engine, a cam shaft is rotatably mounted in a cylinder head. The cylinder head includes a plurality of journals longitudinally spaced along its length. The journals define a cam shaft axis and support the cam shaft. A cam sprocket is fixedly attached to the cam shaft. The cam sprocket is coupled to a rotational output of the internal combustion engine through a tension chain.

When it is necessary to service the cylinder head, it is frequently necessary to remove the cam shaft. For example, access to the cylinder heads and cylinders of the internal combustion engine is restricted, if not prevented, unless the cam shaft is removed. When the cam shaft is conventionally removed, the radial position of the cam sprocket is altered and proper tensioning of the tension chain is disturbed. As a result, it is often necessary to recalibrate the tension chain. This process is extremely time consuming as it typically involves removal of the oil pan and the front chain case cover.

Thus, it is would be desirable to remove a cam shaft from the cylinder head of an internal combustion engine while maintaining proper radial alignment of the cam sprocket.

SUMMARY OF THE INVENTION

It is a general object of the present invention to provide a method and apparatus for servicing a cylinder head of an internal combustion engine which overcome the disadvantages associated with the prior art, including but not limited to those discussed above.

It is another object of the present invention to provide a method and apparatus for maintaining radial alignment of a cam sprocket while the cam shaft of an engine cylinder head is removed.

In one form, the present invention provides an apparatus for maintaining radial alignment of a cam sprocket during removal of a cam shaft of an engine cylinder head. The apparatus includes a mounting portion adapted to be removably attached to the engine cylinder head. The apparatus additionally includes a support portion for radially supporting the cam sprocket. The support portion is generally cylindrical in shape and adapted to align with the cam shaft.

In another form, the present invention provides a method of servicing an engine cylinder head. The general steps of the present invention include providing a sprocket mounting member, removably attaching the sprocket mounting member to the engine cylinder head, radially supporting the cam sprocket on the sprocket mounting member, removing the cam shaft from the engine cylinder head, and maintaining a radial position of the cam sprocket.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1A:
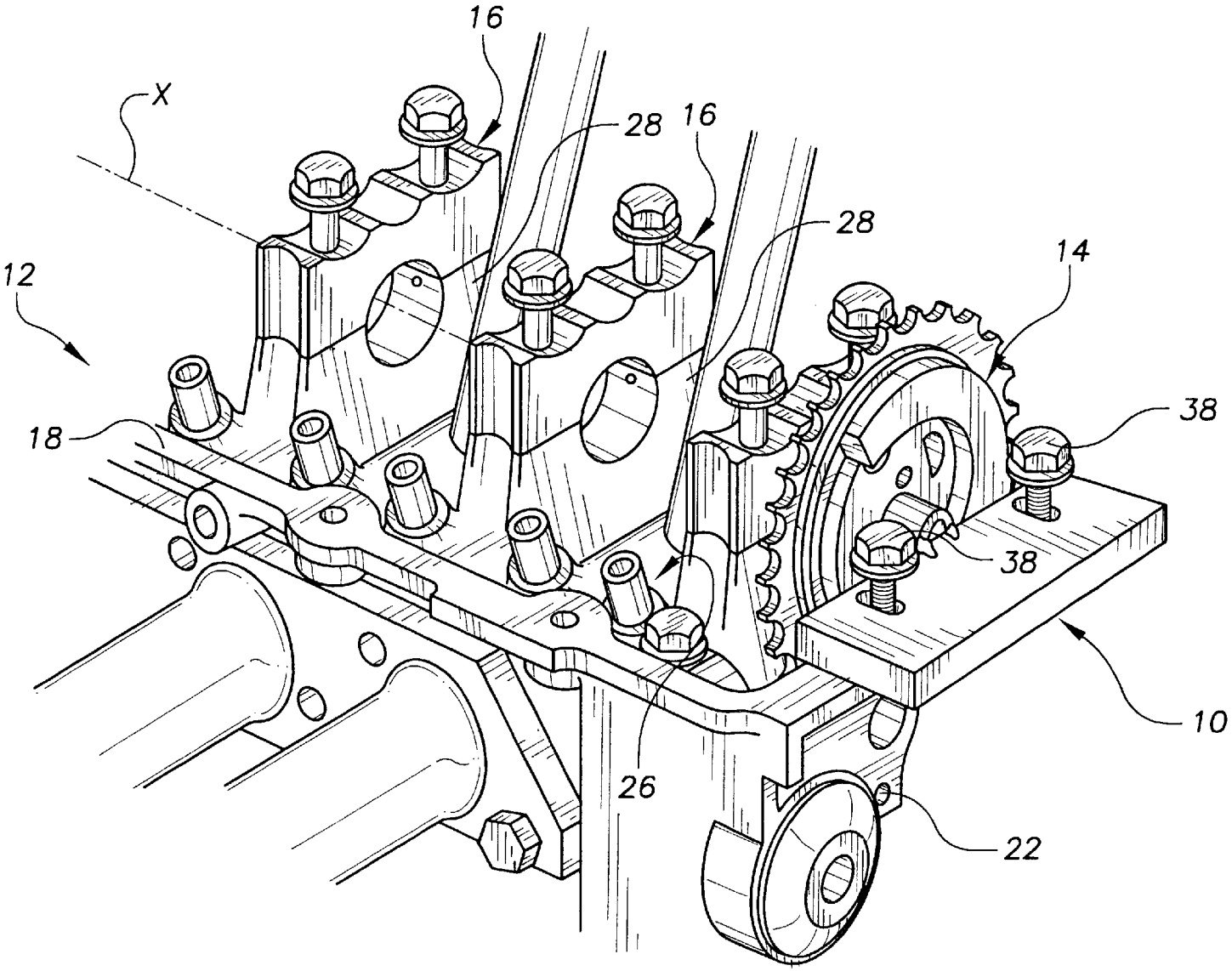
FIG. 1A is a perspective view of an apparatus constructed in accordance with the teachings of a preferred embodiment of the present invention, the apparatus shown operatively associated with an engine cylinder head and a cam sprocket.
Figure 1B:
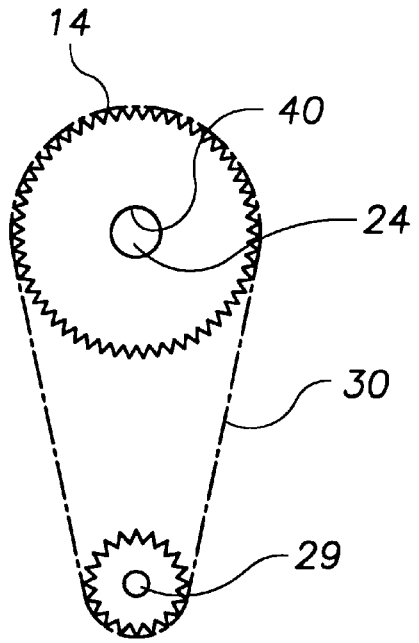
FIG. 1B is a simplified side view of the cam sprocket of FIG. 1A shown operatively associated with a cam shaft and interconnected to a crankshaft through a tension chain.

With initial reference to the environmental view of FIG. 1A and the simplified side view of FIG. 1B, an apparatus constructed in accordance with the teachings of a preferred embodiment of the present invention is generally identified with reference numeral 10. The apparatus 10 is shown operatively associated with an engine cylinder head 12. The apparatus 10 of the present invention is specifically intended to maintain a radial position of a cam sprocket 14 of the engine cylinder head 12 while a cam shaft 24 (shown in FIG. 1B) of the engine cylinder head 12 is removed.

Prior to addressing the construction and operation of the apparatus 10 of the present invention, a brief understanding of its exemplary use environment is warranted. The cylinder head 12 includes a plurality of journals 16 longitudinally spaced along its length. The journals define a cam shaft axis X. The cylinder head 12 includes two longitudinally extending sidewalls 18 and two laterally extending sidewalls 22 which cooperate to partially define a cylinder head cavity 26. Extending transversely across the cylinder head cavity 26 and in lateral alignment with each cam shaft journal 16 is a web or bulkhead 28 which connects with opposite sidewalls 18 and which are integrally formed therewith. As shown in FIG. 1B, the cam sprocket 14 is normally mounted for rotation on the cam shaft 24. In a conventional manner, the cam sprocket 14 is coupled to a crankshaft 29 through a chain 30 which is maintained in tension (e.g. a tension chain).

Figure 2:
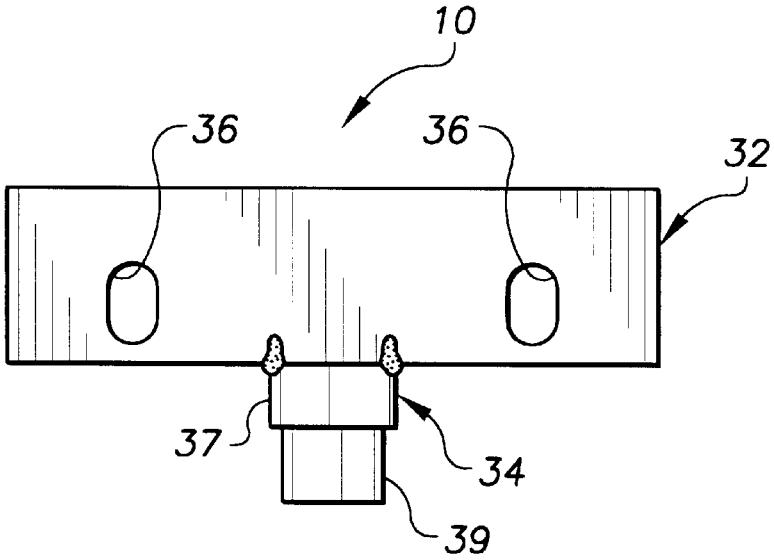
FIG. 2 is a top view of the apparatus of FIG. 1A removed from the engine cylinder head for purposes of illustration.
Figure 3:
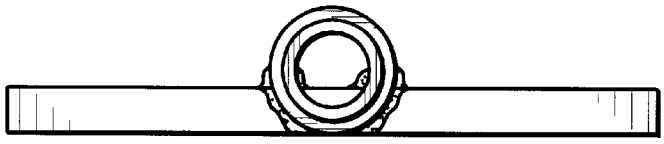
FIG. 3 is an end view of the apparatus of FIG. 2.

With continued reference to FIG. 1A and additional reference to FIGS. 2 and 3, the apparatus 10 of the present invention is generally illustrated to include a mounting portion 32 and a cam sprocket supporting portion 34. The mounting portion 32 is illustrated in the exemplary embodiment to be generally planar in shape. The mounting portion 32 is formed to include a pair of elongated slots 36 which are adapted to align with existing apertures in one of the laterally extending sidewalls 22 of the cylinder head 12. Threaded fasteners 38 pass through the elongated slots 36 and engage existing apertures (not specifically shown) of the cylinder head 12 to facilitate removable attachment of the apparatus 10 to the cylinder head 12 adjacent the cam sprocket 14.

The supporting portion 34 is preferable shown to be generally cylindrical in shape. The supporting portion 34 extends generally parallel to a plane defined by the mounting portion 32. In the exemplary embodiment, the supporting portion 34 includes a first portion 37 having a first diameter and a second portion 39 having a second, smaller diameter. The supporting portion 34 is adapted to be aligned along the cam shaft axis X and inserted into a central aperture 40 of the cam sprocket 14. The second portion 39 is sized to be received into the central aperture 40, whereas the first portion 37 is slightly larger than the central aperture 40. As a result, the first portion 37 functions to maintain a space between the mounting portion 32 of the apparatus 10 and the cam sprocket 14.

In the preferred embodiment, the mounting portion 32 and the supporting portion 34 are constructed from steel. However, those skilled in the art will appreciate that other suitable materials having sufficient strength requirements may alternatively be used. As shown, the supporting portion 34 is welded or otherwise suitably attached to or integrally formed with the mounting portion 32.

Figure 4:
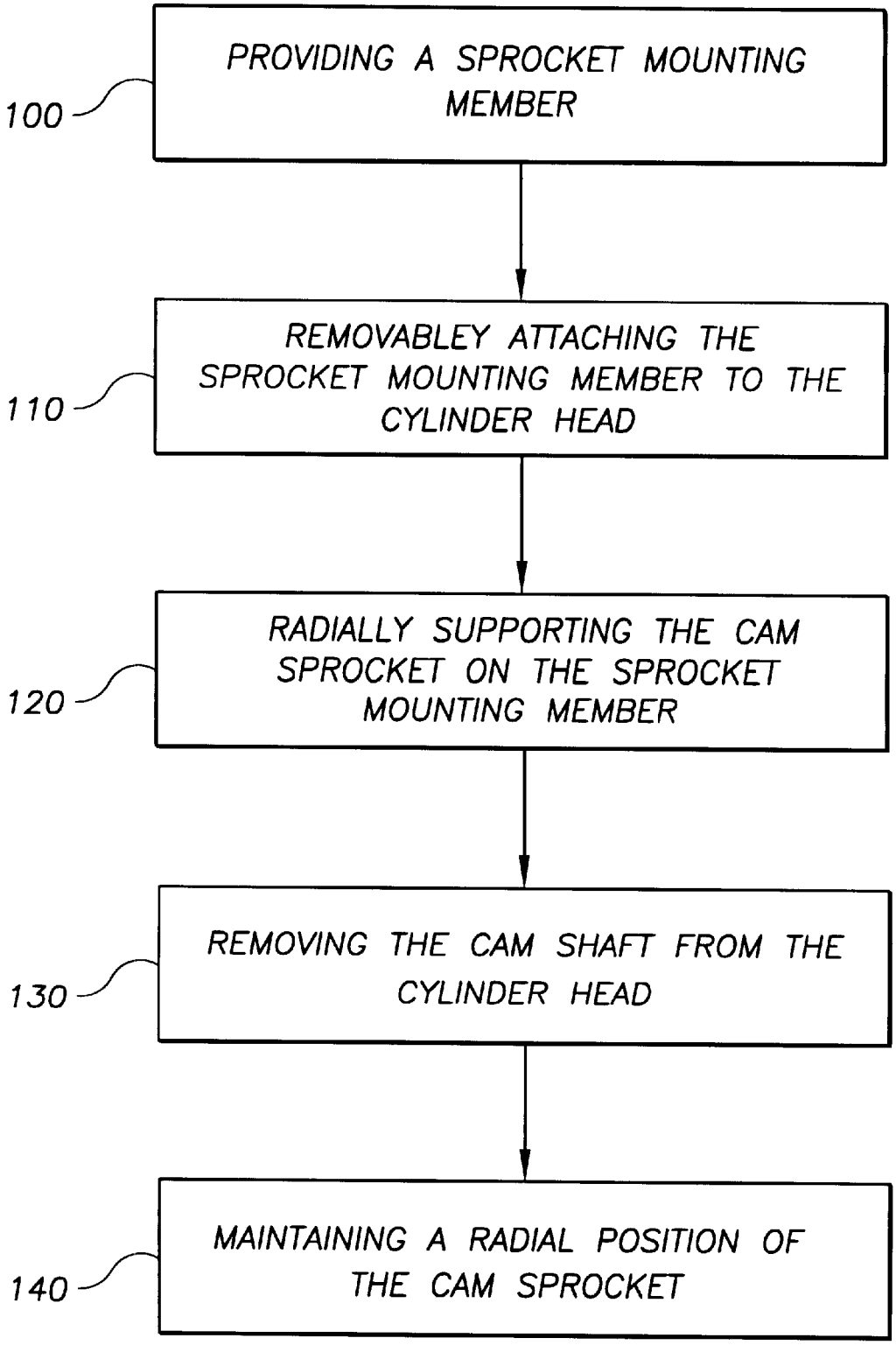
FIG. 4 is a schematic representation of the general steps of the method of the present invention.

With continued reference to FIGS. 1 through 3 and additional reference to FIG. 4, a preferred method of the present invention will now be described. In a first general step 100, a sprocket mounting member substantially identical to the apparatus 10 of the present invention is provided. In a second general step 110, the sprocket mounting member 10 is removably attached to the engine cylinder head 12. In a third general step 120, the cam sprocket 14 is radially supported on the sprocket mounting member 10. In a fourth general step 130, the cam shaft 24 is removed from the engine cylinder head 12. In a fifth general step 140, a radial position of the cam sprocket 14 is maintained.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. An apparatus for maintaining radial alignment of a cam sprocket during removal of a cam shaft of an engine cylinder head in combination with the engine cylinder head, the apparatus comprising:

a mounting portion removably attached to the engine cylinder head; and a support portion for radially supporting the cam sprocket, the support portion being generally cylindrical in shape and adapted to align with the cam shaft.

2. The apparatus for maintaining radial alignment of a cam sprocket during removal of a cam shaft of an engine cylinder head in combination with the engine cylinder head of claim 1, wherein said mounting portion includes a pair of apertures adapted to align with a pair of apertures in the engine cylinder head.

3. The apparatus for maintaining radial alignment of a cam sprocket during removal of a cam shaft of an engine cylinder head in combination with the engine cylinder head of claim 1, wherein said mounting portion is generally planar, and further wherein said support portion extends substantially parallel to a plane defined by said mounting portion.

4. The apparatus for maintaining radial alignment of a cam sprocket during removal of a cam shaft of an engine cylinder head in combination with the engine cylinder head of claim 1, wherein said support portion is welded to said mounting portion.

* * * * *